United States Patent [19]

Nowick et al.

[11] 4,129,410

[45] Dec. 12, 1978

[54] METHOD OF DRYING GYPSUM WALLBOARD AND APPARATUS THEREFOR

[75] Inventors: Chester R. Nowick, Williamsville; Alfred de Franza, Buffalo, both of N.Y.

[73] Assignee: National Gypsum Company, Dallas, Tex.

[21] Appl. No.: 825,403

[22] Filed: Aug. 17, 1977

Related U.S. Application Data

[63] Continuation-in-part of Ser. No. 668,085, Mar. 18, 1976, Pat. No. 4,050,885.

[51] Int. Cl.[2] ..... F27B 17/00

[52] U.S. Cl. ..... 432/31; 431/158; 432/222; 432/225

[58] Field of Search ..... 34/DIG. 14; 55/10; 432/31, 222, 225; 431/158

[56] References Cited

U.S. PATENT DOCUMENTS

| | | | |
|---|---|---|---|
| 2,577,918 | 12/1951 | Rowe | 431/158 X |
| 3,224,486 | 12/1965 | Geller et al. | 431/158 X |
| 3,296,713 | 1/1967 | Larsen et al. | 34/225 X |
| 3,882,612 | 5/1975 | Try et al. | 34/212 |
| 3,932,115 | 1/1976 | Alms et al. | 432/222 |
| 4,050,885 | 9/1977 | Norwick et al. | 432/31 |

*Primary Examiner*—John J. Camby
*Attorney, Agent, or Firm*—Robert F. Hause

[57] ABSTRACT

The air flow in one zone of a gypsum wallboard dryer involves removal of the air from the wallboard drying section at one end of the elongate wallboard drying section, followed by directing a major portion of this air through fans to accelerate the air flow, next heating the air in an elongate plenum, through which the air passes, by directing high intensity flame angularly into the air flow from the periphery of the elongate section, thus creating agitation within the air flow to create uniformity of temperature therethroughout prior to directing the heated, thoroughly mixed air back into the wallboard drying section, at an end of the section opposite to the end from which it was originally removed.

6 Claims, 7 Drawing Figures

METHOD OF DRYING GYPSUM WALLBOARD AND APPARATUS THEREFOR

The application is a continuation-in-part of our copending application, Ser. No. 668,085, filed Mar. 18, 1976, now U.S. Patent No. 4,050,885.

This invention relates to the drying of gypsum wallboard. The manufacture of gypsum wallboard involves forming an aqueous slurry of cementitious material between a back paper liner and a front paper liner, and allowing the cementitious material to set and harden. This process requires the use of an excess of water over that which reacts and causes the cementitious material to set and harden, and this excess water must be removed prior to storage or shipment of the completed wallboard. In a typical plant, producing a 4 foot (1.2 meter) wide continuous web of wallboard at a rate in excess of 100 lineal feet (30 meters) per minute, the amount of excess water in the core which must be converted to steam and removed from the board can exceed 24,000 pounds (11,000 kg) per hour.

A common form of gypsum wallboard dryer includes a plurality of drying zones in each of which there is a drying section containing several tiers of roller conveyors which receive wallboard at the inlet end, covey the wallboard through the drying section and discharge the wallboard at the outlet end. Hot air for drying the wallboard is heated in a plenum located over the drying section of each drying zone. The air is circulated from one end of the drying section upward into the plenum, through the plenum where it is reheated, and then back into the drying section at the opposite end, to flow through the drying section and back again to the plenum.

In one form of one of the zones of a prior gypsum wallboard dryer, a large combustion unit is located in the plenum near the inlet for the air into the plenum. The combustion unit consists of a combustion tube which is about 20 feet (6 meters) long and 6 feet (2 meters) in diameter, extending 20 feet (6 meters) along the length of the plenum. An oil burner is located within the combustion tube, producing a flame which extends the length of the combustion tube. The circulating air is heated as it passes the combustion tube and as it combines with the products of combustion coming from the combustion tube.

This heated air then passes through a pair of large fans, provided for circulating the hot air. Since the air is heated before passing through the hot air recirculating fans, the air is less dense than it would be if it were to go through the fans before being heated, and being less dense, the fans must either do a greater amount of work than they would do to recirculate the air with the colder, denser air going through the fans, or with the same work, a smaller mass of air would be recirculated.

An attempt was made to place the prior common 20 feet combustion chamber at the opposite end of the plenum, directed upstream; however, with this arrangement the air passing by the exterior of the combustion tube was air that had already been heated and combined with the products of combustion, and as a result they did not perform the cooling of the exterior of the combustion tube necessary to prevent it from rapidly disintegrating. Furthermore, a uniform temperature mixing balance was not achieved.

In accordance with the present invention, recirculating air is passed through the fans prior to reheating and then reheated by high intensity flames directed angularly into the airstream, downstream of the recirculating fans. The high intensity flames can be located in a position which causes them to develop considerable turbulence in the airstream, to produce good mixing of the hot and the relatively cooler portions of air. The high intensity burners have a relatively short length of about 2 feet (0.6 meter) which permits their placement in positions which will create the greatest turbulence.

A very significant savings in fuel is provided by the present invention when a sonic nozzle is employed in the high intensity burners of the present invention.

It is an object of the present invention to provide an improved method of drying gypsum wallboard, with improved efficiencies without any loss in quality.

It is a further object of the invention to provide an improved gypsum wallboard dryer.

These and other objects and advantages of the present invention will be more fully apparent when considered in relation to the preferred embodiments thereof as set forth in the specification and as shown in the drawings in which.

Figure 1:
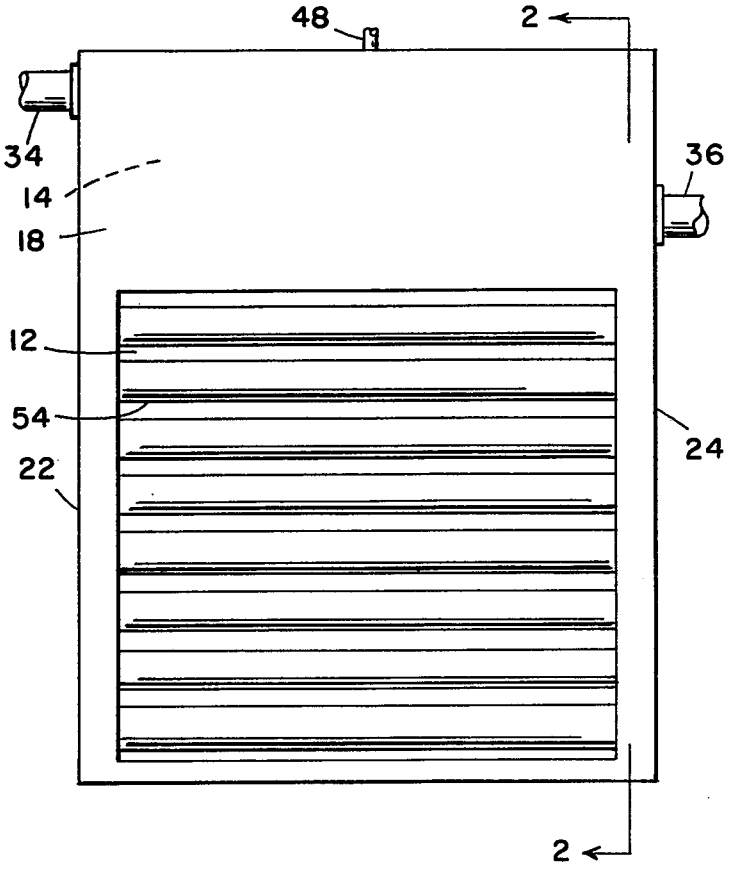
FIG. 1 is a vertical end view of a gypsum wallboard dryer embodying the present invention.
Figure 2:
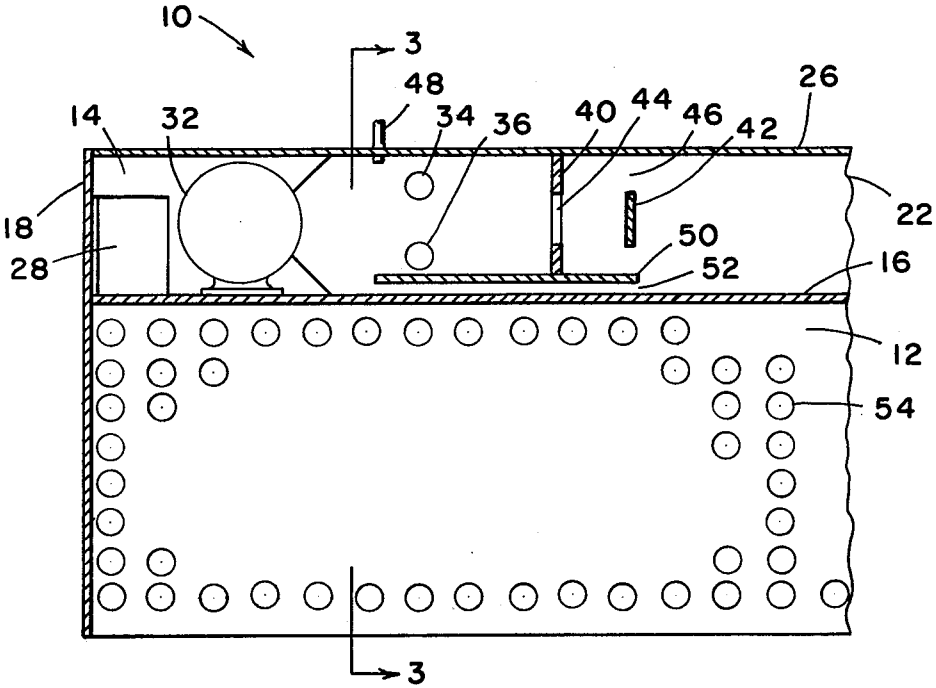
FIG. 2 is a vertical cross-section from the side of the dryer taken on line 2—2 of FIG. 1.
Figure 3:
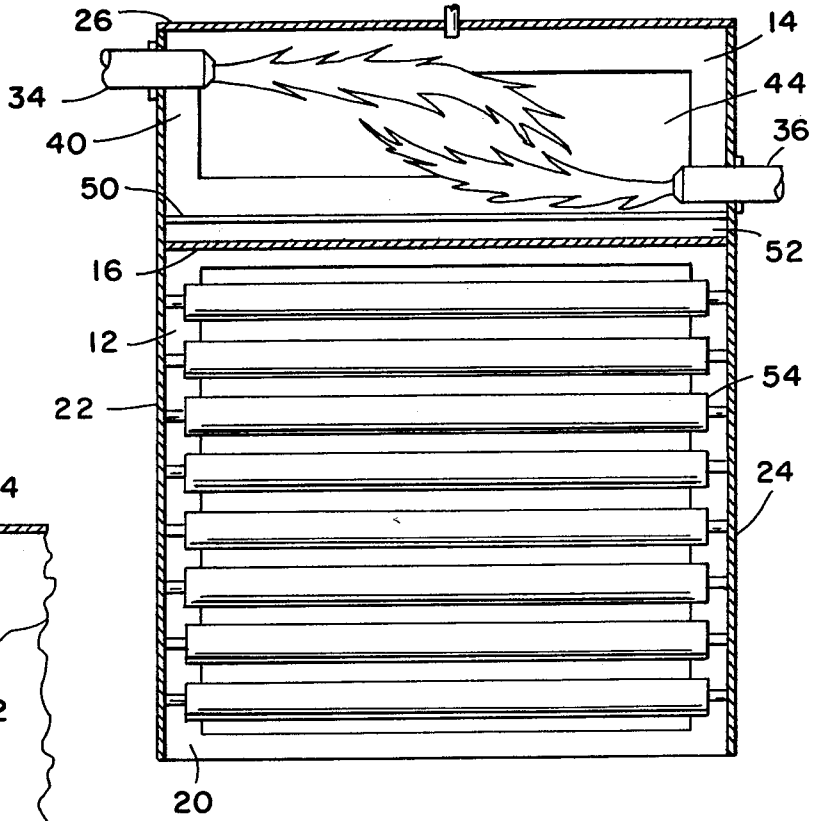
FIG. 3 is a vertical cross-section of the dryer of FIG. 2 taken on line 3—3.

Referring to FIGS. 1–4, there is shown one zone 10 of a gypsum wallboard dryer having a wallboard drying section 12 and a plenum 14 wherein the circulating air is reheated. The plenum 14 is located over the drying section 12, with plenum floor 16 which is also the top of the drying section 12.

The plenum 14 also includes end walls 18, 20, side walls 22, 24 and a top wall 26.

The plenum 14 has a pair of air inlet manifolds 28, 28 near end wall 18 and a pair of air outlet manifolds 30, 30 near end wall 20. Air inlet manifolds 28, 28 are for passage of air from drying section 12 into plenum 14, for reheating of the air, and air outlet manifolds 30, 30 are for passage of reheated air back into the drying section 12.

Two large recirculating fans 32 are located, one on each side, in plenum 14 as near to air inlet 28 as practical, which draw into them all of the air coming into the plenum, and force it on through the plenum and out the air outlet 30. Immediately after air leaves the circulating fans 32 it passes through the high intensity jets of hot air which are produced by a pair of high intensity burners 34, 36 which extend through the plenum side walls 22, 24, with combustion chambers 38 about 26 inches (66 cm) long, disposed within and perpendicular to the walls 22, 24.

Figure 6:
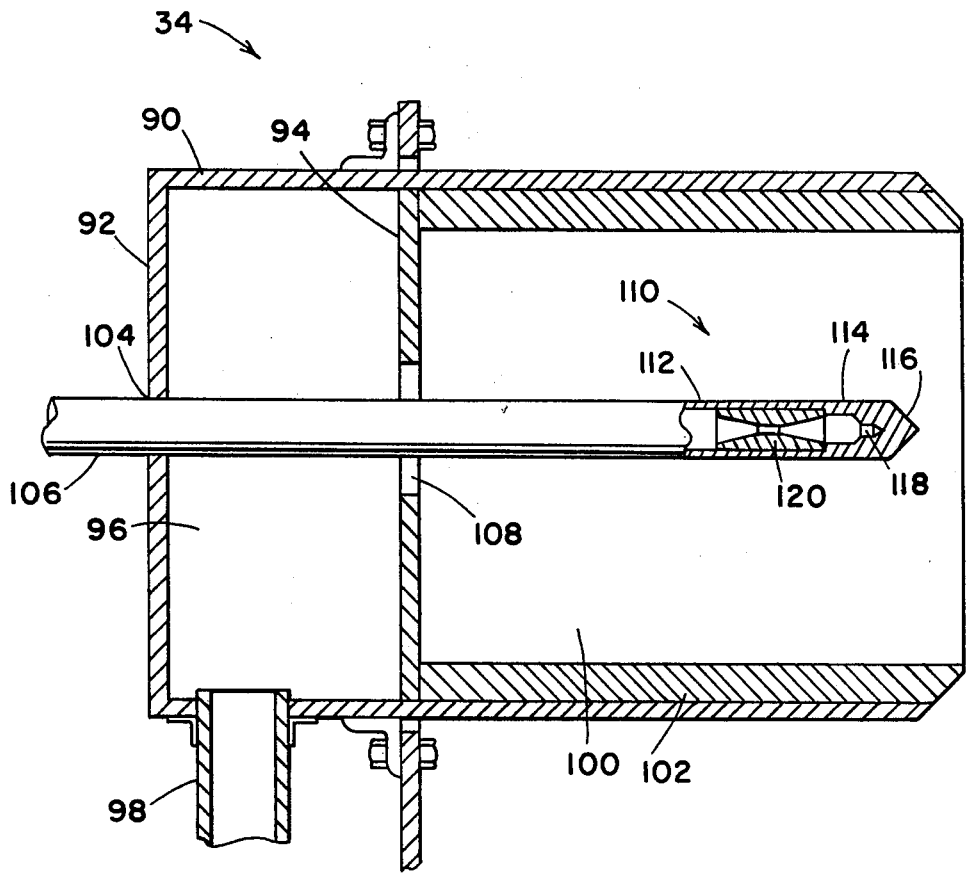
FIG. 6 is a cross-section of an improved form of high intensity burner with a sonic nozzle for use in the dryer of FIG. 1.
Figure 7:
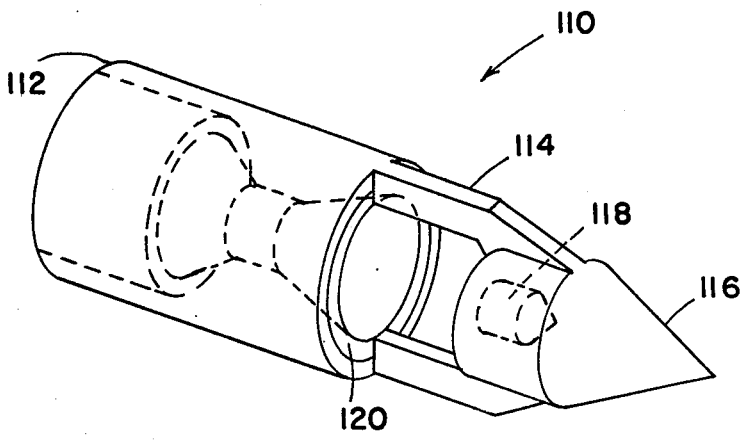
FIG. 7 is an isometric view of the sonic nozzle portion of the burner of FIG. 6.

High intensity burners 34, 36 are constructed, as shown in FIG. 6, using a cylindrical exterior shell 90, with a back wall 92 and a center wall 94. Between back wall 92 and center wall 94 is an air inlet chamber 96 fed by air pipe 98. On the opposite side of center wall 94 is a combustion chamber 100, which is surrounded by a cylindrical refractory 102 which protects the shell 90.

Extending through a closely fitting hole 104 in back wall 92 is a fuel and high pressure air supply pipe 106. Pipe 106 projects on through a relatively large hole 108 in the center wall 94, and has at its outer end a sonic nozzle 110, having a configuration such as that shown in U.S. Pat. No. 3,232,267.

The sonic nozzle 110 consists of a tubular-shaped section 112 connected to leg-like members 114, terminating in a conically-shaped end 116 containing a pulsator cavity 118 with its opening facing tubular member 112.

A cylindrical reduced diameter orifice member 120 is mounted inside tubular section 112. Pressurized air flows from a supply (not shown) through orifice 120 and emerges in the form of a jet which is intercepted by pulsator cavity 118. This develops sonic wave pressure wave energy in the region between the exit from orifice 120 and the pulsator cavity 118. Powerful sonic pressure waves then spread outwardly from this intense core of energy.

Burners 34, 36 can be used to burn all gaseous and liquid fuels, producing a very short flame with exit velocities of about 100 ft/sec. (30 meters/sec).

The fuels are combined with the pressurized air that flows through the sonic nozzle 110 in each burner. Additional air is forced through air inlet chamber 96 from pipe 98, which then passes through the hole 108 in center wall 94. This air passing through hole 108 has a velocity of about 100 ft/sec. (30 meters/sec). The total air being used is supplied at ratios, to the fuel, only slightly greater than a stoichiometric ratio. The fuels are so finely atomized by the energy of the sonic pressure waves that the intensity of the combustion in the combustion chamber 38 is greater than that which is produced with higher velocities of the inlet air but without sonic nozzles.

The combustion is so rapid and complete that the two opposed burners 34, 36 can be placed directly opposite each other, producing a new form of turbulence, if desired. Combustion is substantially complete by the time the flame reaches the end of the approximately 26-inch (66-cm) long combustion chamber. The flame reaches a temperature of about 3000° F. (1600° C.) in the combustion chamber 38.

In a preferred embodiment, the hot gases produced by burners 34, 36 proceed in a direction which is initially perpendicular to the flow of the recirculating air from fans 32. The perpendicular relationship between the flow of recirculating air and the flow of the hot gases from each burner creates a resultant spiral flow of some of the gases, due to the location of the burners as shown, one burner 34 about 1½ feet (about ½ meter) above the center line of one side wall 22, the other burner 36 about 1½ feet below the center line of the other side wall 24. The plenum side walls are each about 8 feet (2½ meters) high, and the plenum is about 10 feet (3 meters) wide.

The spiral flow developed in the plenum results in considerable agitation and thus a good initial admixture of recirculating air with the hot gases produced by the burners 34, 36.

A few feet downstream from burners 34, 36 is a picture frame baffle 40 and a few feet beyond is a target baffle 42. The picture frame baffle 40 is effectively a wall across the plenum with a centered half portion of the area removed. The target baffle 42 is the centered half portion of the picture frame baffle disposed in a centered portion of a plane parallel to the plane of the picture frame baffle.

Thus the picture frame baffle 40 forms a passage 44 through its center which is one-half the area of the total plenum cross-section. The target baffle 42 forms a passage 46 around its periphery which is also one-half the area of the total plenum cross-section.

The two baffles 40, 42 provide a different form of agitation from the form caused by the colliding perpendicular flows and the resultant spiral flow discussed above, which, thus combined, results in more highly agitated air flow and very thorough mixing of the hot gases with the recirculating air. Thorough mixing is vital to the attainment of a suitably uniform temperature of air being supplied through the air outlet 30 to the drying section 12, to provide a thermodynamic balance necessary in drying of the gypsum wallboard.

A desirable set of temperature conditions can be one in which 350° F. (175° C.) air enters at air inlet 28, to be mixed with 3000° F. (1600° C.) products of combustion, which when thoroughly mixed results in 550° F. (290° C.), or higher, heated air, with a uniform temperature throughout, returning to the drying section. Each burner can be of a size sufficient to produce from about 10 to 15 million BTUs per hour.

An exhaust 48 is located between fans 32 and burners 34, 36, to exhaust some of the air from plenum, and thus some of the humidity picked up by the air during a previous wallboard drying cycle.

An additional preferred element of the invention is a partial false floor 50 on that portion of the plenum 14 extending from the area just after the fans 32 to the area just after the baffles 40, 42, which creates a very small cooling passage 52 between floor 16 and false floor 50. A small portion of the recirculating air from fans 32 passes through passage 52, preventing any of the very high temperature gases from burners 34, 36 from heating floor 16 excessively. The purpose is to prevent the top of the drying section 12 from being hot enough from radiation to cause the drying of gypsum wallboard at the top of drying section 12 to be at a rate any faster than any of the gypsum board at lower levels in the drying section 12. Excessive drying of gypsum wallboard drives off the essential water of hydration in the gypsum molecules, destroying the wallboard.

The drying section 12 consists of eight levels of roller conveyors 54, on each of which gypsum wallboard is continuously conveyed, to be dried by the reheated air from air outlet 30. It is very critical that the air to all portions of the drying section be at a uniform temperature to avoid destroying the wallboard.

Figure 5:
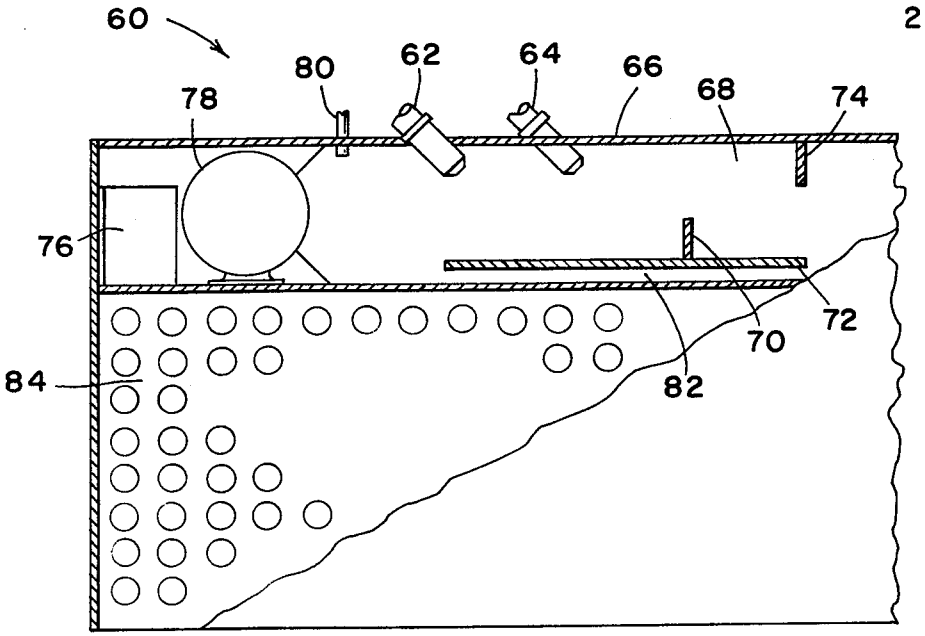
FIG. 5 is a vertical cross-section similar to FIG. 2 of a modified gypsum wallboard dryer embodying the present invention.
Figure 4:
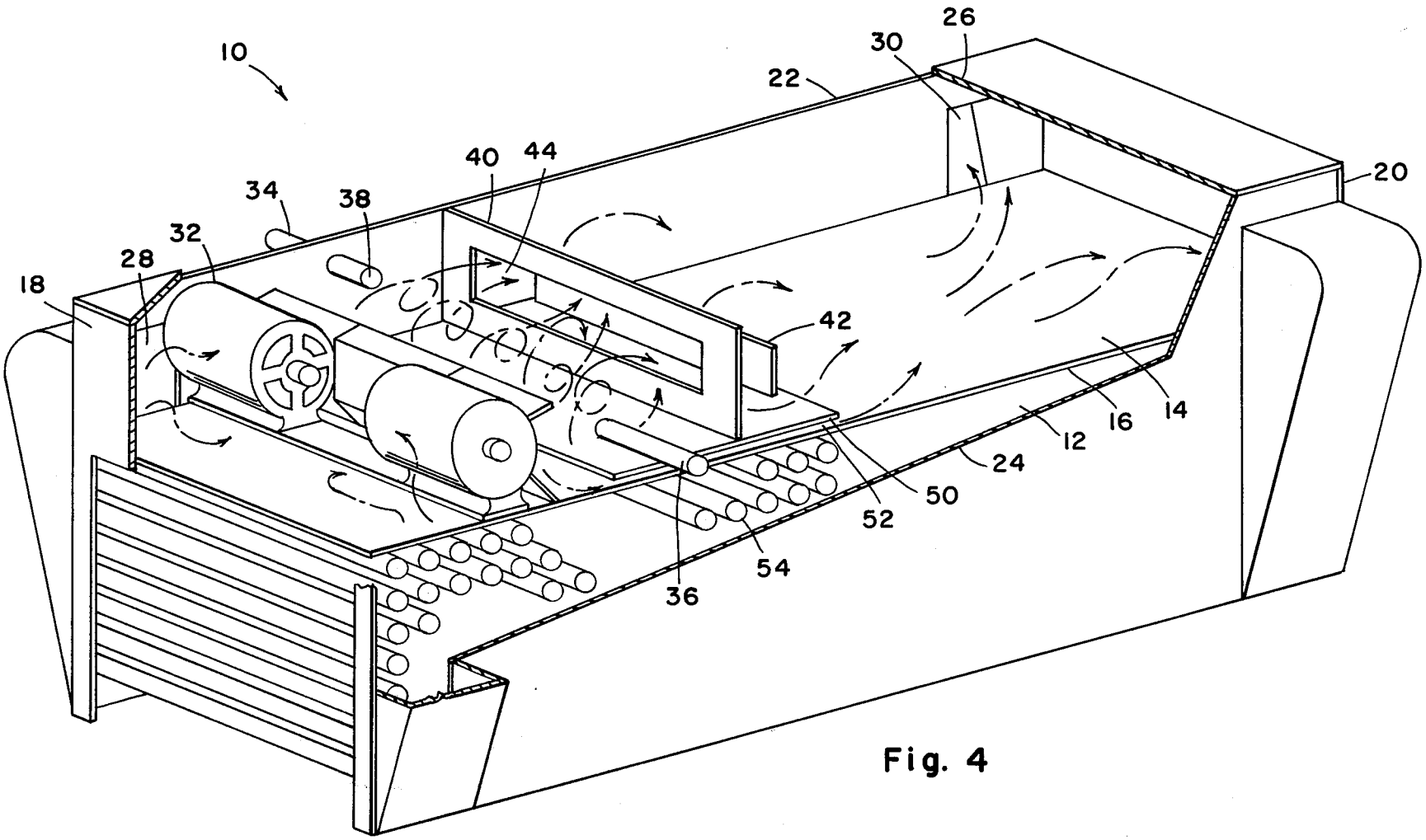
FIG. 4 is an isometric view of the dryer of FIG. 1, parts being broken away, showing the air flow therewithin.

FIG. 5 shows a modified form of gypsum wallboard dryer 60 in which burners 62, 64, which are the same as burners 34, 36, are disposed at an acute angle extending through the top wall 66 of plenum 68. Preferably burners 62, 64 are displaced from the plenum center line, on opposite sides. A baffle 70 downstream from burners 62, 64 extends upward from a false floor 72 and a baffle 74 downstream from baffle 70 extends downward from top wall 66. Recirculating air is drawn through air inlet manifolds 76, 76 through fans 78, past burners 62, 64 and around baffles 70, 74, where the combustion gases and recirculating air is thoroughly mixed. A portion of the air from fans 78 is exhausted through exhaust 80 and a small portion of air from fans 78 passes through a passage 82 under false floor 72, to protect the gypsum wallboard near the top of drying section 84 from the heat from burners 62, 64. False floor 72 extends downstream to about the area of baffle 74.

As shown, the short, high intensity burners may extend through the plenum side walls or the top wall at an angle to the direction of flow of air from the circulating air fans, and this angle should be from about 45° to 135°, preferably 90°. The burners extend about 2 feet (½ meter) into the plenum air flow, and are aimed toward an opposite surface of the plenum with a distance thereto of at least about 6 feet (2 meters).

Having completed a detailed disclosure of the preferred embodiments of our invention, so that others may practice the same, we contemplate that variations may be made without departing from the essence of the invention.

We claim:

1. The method of drying gypsum wallboard in a wallboard dryer having (1) a drying section with means for conveying wallboard therethrough at a plurality of spaced apart levels, and (2) an elongate gas reheating plenum section having elongate exterior walls separating the interior of said plenum from the exterior thereof, having means for moving gases from said dryer section into and on through said plenum and back to said dryer section, and having combustion means in said walls for propelling heated products of combustion, said method comprising the steps of (a) continuously conveying a plurality of undried gypsum wallboards into and through said drying section at said plurality of levels, (b) drying said wallboards at an equal rate at all said levels by passing heated gases through said drying section, which said gases are at a uniform temperature throughout as said gases enter said drying section, (c) providing said uniform temperature heated gases by moving gases from said dryer section through said means for moving gases and from said moving means on through said plenum whereat said means for propelling heated products of combustion directs heated products of combustion crosswise of said plenum at an angle of from about 45° to about 135° to the direction of flow of said gases from said moving means, and mixing said heated products of combustion thoroughly with substantially all of said gases by the turbulence caused by the combination of said combustion and said crossed directions of flow of said products of combustion and substantially all of said gases to be heated, lowering the temperature of said products of combustion to about 550° F. upon being mixed with said gases which intersect with said flow of products of combustion, and (d) propelling said heated products of combustion by feeding fuel and air through a sonic nozzle, and creating intense sonic waves at the outlet portion of said sonic nozzle whereby said fuel is caused to be divided into extremely fine particles, creating a high intensity flame which contributes to the propelling of said products of combustion.

2. The method of claim 1 wherein a portion of the air for combustion is fed under high pressure through said sonic nozzle and another portion of the air for combustion is fed through a wall forming the rear of a combustion chamber, which said combustion chamber is formed by a wall disposed extending around said sonic nozzle.

3. The method of claim 2 wherein said portion of air fed through said wall is fed at a rate of at least about 100 feet per second.

4. A gypsum wallboard dryer comprising (1) a drying section with means for conveying wallboard therethrough at a plurality of spaced apart levels, and (2) an elongate gas reheating plenum section having elongate exterior walls separating the interior of said plenum from the exterior thereof, having means for moving gases from said dryer section into and on through said plenum and back to said dryer section, and having combustion means in said walls for propelling heated products of combustion, (a) said combustion means in said walls being disposed to direct products of combustion crosswise of said plenum at an angle of from about 45° to about 135° to the direction of flow of gases from said gas-moving means, and (b) said combustion means consisting essentially of a plurality of high intensity burners extending through plenum walls and each having an open-ended outer shell, a sonic nozzle centrally disposed within said outer shell, means for ejecting fuel and pressurized air through said sonic nozzle, said sonic nozzle having a pulsator cavity with an opening facing a tubular outlet for said fuel and pressurized air whereby said fuel is atomized by sonic pressure waves formed adjacent said outlet.

5. A gypsum wallboard dryer as defined in claim 4 wherein said high intensity burners have means for feeding air for combustion at a velocity of about 100 ft/sec. longitudinally through said shell surrounding said sonic nozzle.

6. A gypsum wallboard dryer as defined in claim 4 wherein said high intensity burners having said sonic nozzles have a length of about 2 feet.

* * * * *